United States Patent [19]

Klein et al.

[11] Patent Number: 4,578,742

[45] Date of Patent: Mar. 25, 1986

[54] REMOVABLE LAMPHOLDER

[75] Inventors: Roy S. Klein, Erie; Joel C. Gehly, McKean; Joseph T. Sestak, Erie, all of Pa.

[73] Assignee: American Sterilizer Company, Erie, Pa.

[21] Appl. No.: 664,356

[22] Filed: Oct. 24, 1984

[51] Int. Cl.[4] ..... F21V 25/02

[52] U.S. Cl. ..... 362/294; 362/226; 362/310; 362/373; 362/439

[58] Field of Search ..... 362/226, 277, 294, 307, 362/310, 311, 373, 437, 443, 804, 268, 308, 327, 328, 329, 363, 378, 439

[56] References Cited

U.S. PATENT DOCUMENTS

| | | | |
|---|---|---|---|
| 4,195,331 | 3/1980 | Jones | 362/804 X |
| 4,394,715 | 7/1983 | Dahlberg | 362/311 X |
| 4,437,142 | 3/1984 | Donato et al. | 362/277 X |

FOREIGN PATENT DOCUMENTS

| | | | |
|---|---|---|---|
| 0813619 | 5/1959 | United Kingdom | 362/226 |

*Primary Examiner*—W. R. Wolfe

*Attorney, Agent, or Firm*—Robert D. Yeager; Christine R. Ethridge

[57] ABSTRACT

A lampholder for insertion into and removal from an electrically powered lighting unit which includes a socket for receiving the lamp, means for communicating electrical power from the unit to the lamp, means for releasably engaging the unit, and a cap structured to prevent cracking superposing the socket and having an upper surface and a lower surface proximate the socket. A plurality of windows through the cap of a sufficient size to vent heat emitted from the lamp, together with the heat resistant material from which the cap is formed, prevent the upper surface from exceeding a predetermined temperature. An insulation layer is preferably disposed between the lower surface and the socket.

14 Claims, 6 Drawing Figures

REMOVABLE LAMPHOLDER

BACKGROUND OF THE INVENTION

1. Field of the Invention

The present invention relates to a lampholder for use in lighting units, and more specifically, to a removable lampholder.

2. Description of the Prior Art

In that variety of lighting unit which includes a distinct holder for the lamp, or bulb, which must be removed from the lighting unit in order to replace the lamp, the exposed surfaces of the lampholder become very hot to the touch during use of the unit because of the heat normally emitted from the lamp. In special applications during which it is important to replace a weak or burned out lamp quickly to avoid any prolonged interruption of light, the hot exterior surfaces make the lampholder hazardous to remove without the aid of some grasping implement.

A surgical light, such as one manufactured by the American Sterilizer Company of Erie, Pa., includes a lampholder with a metallic cover. A suction device must be used to remove the lampholder during a surgical procedure. The lampholder is connected to the surgical light by electrical wires, thus preventing the complete removal of the lampholder. Partially removing the lampholder to replace the lamp by using the suction device is time consuming and potentially hazardous because the person replacing the lamp may touch the hot exposed surface.

The object of the present invention, therefore, is to provide a lampholder which has an exposed surface which can be safely handled during use. It is a further object of the present invention to provide a lampholder which can be removed from the lighting unit quickly and without the use of auxiliary tools.

SUMMARY OF THE INVENTION

The present invention provides a lampholder for insertion into and removal from an electrically powered lighting unit, such as a surgical light. The lampholder includes a socket and a cap. The socket is for receiving the lamp and communicating electrical power from the unit to the lamp. The cap, which is structured to prevent cracking, superposes the socket. The cap has an upper surface, a lower surface proximate the socket, and at least one window. The window or windows are of sufficient size to vent heat emitted from the lamp when electric power is communicated thereto. The cap is made of such a heat resistant material that the lower surface can tolerate the heat emitted from the lamp and the upper surface, due to the combination of the sufficiently sized windows and the material, will not exceed a predetermined temperature during normal use. Means for releasably engaging the unit are also provided. The predetermined temperature is that required by the Underwriter's Labortories standards for surfaces to be handled by people directly, currently set at 167° F. for nonmetallic surfaces.

The lampholder may also include insulation means, preferably made of the same material as the cap, which is disposed between the lower surface of the cap and the socket. A member may be connected to the lower surface or to the insulation means, which has a bore therethrough for receiving the socket.

The engaging means, which may be a lock ball detent assembly, may be disposed on the member. Alternatively, the member may have an opening for receiving a lock ball from a detent assembly in the unit.

The cap may be made from a material selected from the group consisting of polysulfone, polyether sulfone, polyether imide, polyamide-imide, polyether ether ketone, polyphenylene sulfide, expoxy or a phenolic. The upper surface preferably includes a handle which may be molded from the material forming the cap. The handle formed from the material permits the lampholder to be manually inserted into and removed from the lighting unit while the lamp is hot. The lower surface may be so disposed relative to the upper surface that a first airspace is defined therebetween. The insulation means may be so connected to the lower surface that a second airspace is defined therebetween. The cap may also include a circumferential skirt through which a plurality of sufficiently sized windows are formed. Relief joints to prevent the cracking of the cap from the uneven distribution of heat may be provided, preferably adjacent each window.

The lampholder may also include a plug connected to the member for releasably engaging a first contact in the lighting unit when the lampholder is inserted therein. A second contact, preferably a plurality of wires which connect the socket to the plug permit the communication of electrical power from the unit to the lamp. The plug is of the variety more fully described in the U.S. Ser. No. 664,423, filed 10-24-84 of Joel C. Gehly for "Improved Means For Electrically Connecting Equipment To A Removable Portion Thereof" filed together herewith.

BRIEF DESCRIPTION OF THE DRAWINGS

The following detailed description of the preferred embodiment can better be understood if reference is made to the drawings in which.

DETAILED DESCRIPTION OF THE PREFERRED EMBODIMENTS

FIGS. 1 through 6 illustrate the preferred embodiment of the removable lampholder 10 of the present invention.

Figure 5:
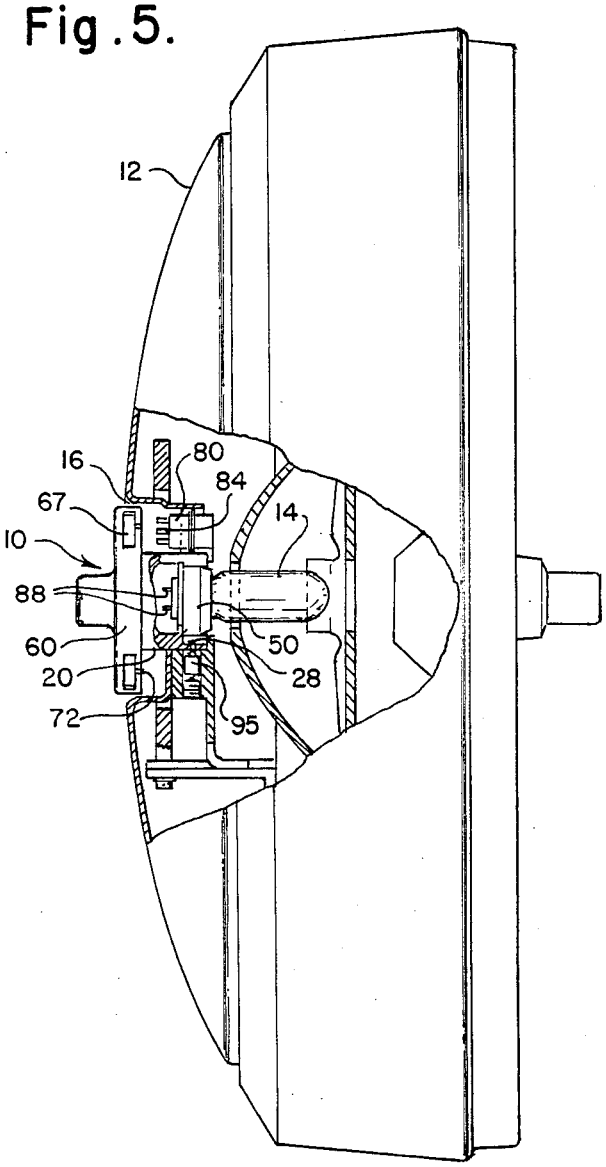
FIG. 5 is a partial section view of the lampholder of the present invention inserted into a lighting unit.

A lighting unit 12 having an opening 16 through which the lamp 14 and the lampholder 10 are inserted is shown in FIG. 5. The lampholder 10 as shown in the drawings can be modified for use with a variety of lighting units and lamps without exceeding the scope of the present invention.

The lampholder 10 includes a socket 50, a cap 60 superposing the socket 50, a barrel member 20, an insulation layer 40 and means for communicating electrical power from the lighting unit 12 to the lamp 14. The power communicating means may be a set of wires joining the socket 50 to the lighting unit 12, but preferably is a plug 80 electrically connected to the socket 50 and adapted to releasably engage electrical contacts in the lighting unit 12. The plug 80 is more fully described in the U.S. Ser. No. 664,423, filed 10-24-84 of Joel C. Gehly, identified above.

The cap 60 has an upper surface 66, a lower surface 68 proximate the socket 50, an annular skirt 63 around the circumference of the cap 60, and a handle 62 connected, by any suitable known means, to the cap 60. The handle 62 is preferably integrally molded on the cap 60 and has indentations 64 to facilitate hand grasping. At least one, and preferably a plurality of windows 67 and relief joints 72 are formed in the skirt 63.

Figure 1:
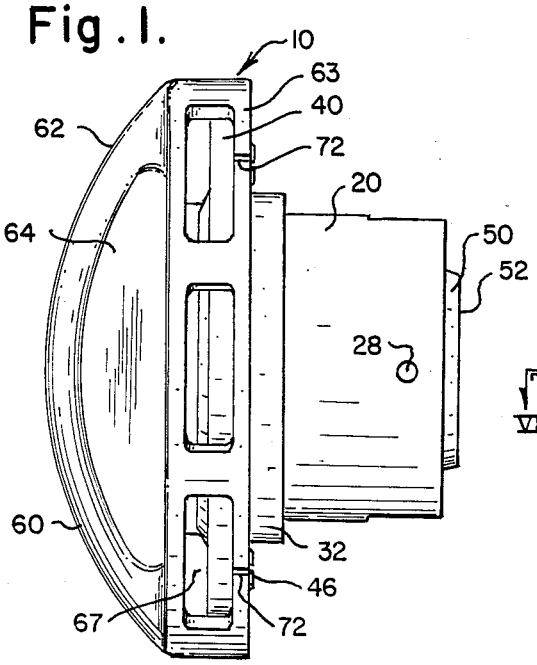
FIG. 1 is a side elevational view of the lampholder of the present invention.
Figure 2:
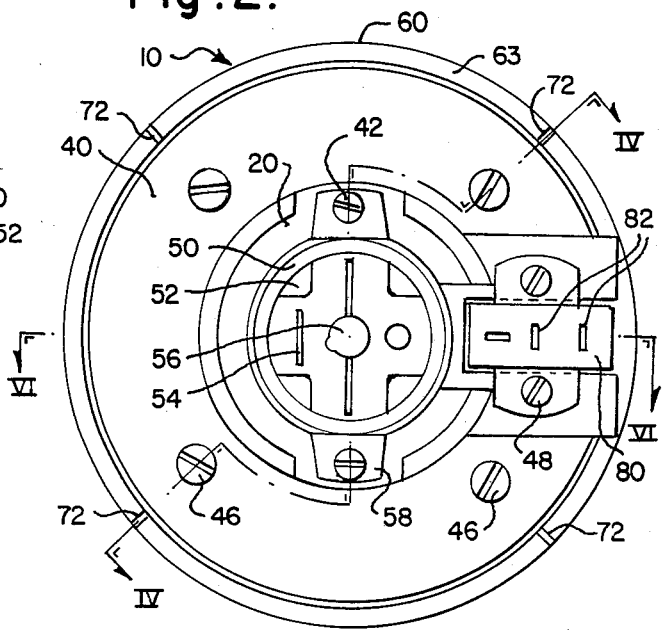
FIG. 2 is a bottom plan view of the lampholder of FIG. 1.
Figure 3:
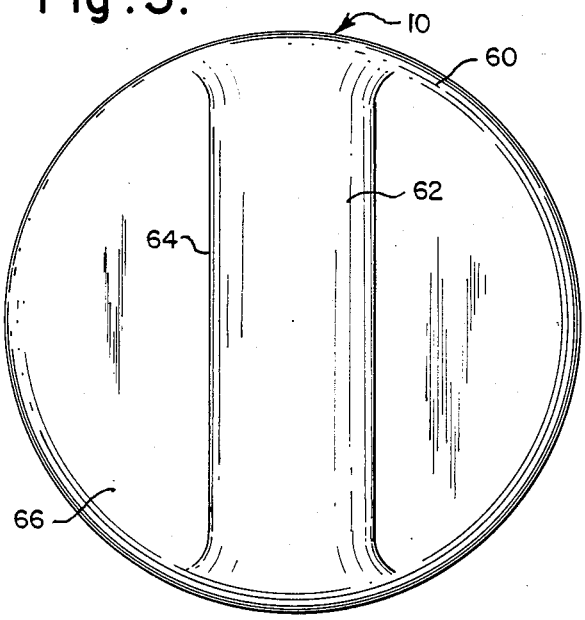
FIG. 3 is a top plan view of the lampholder of FIG. 1.
Figure 4:
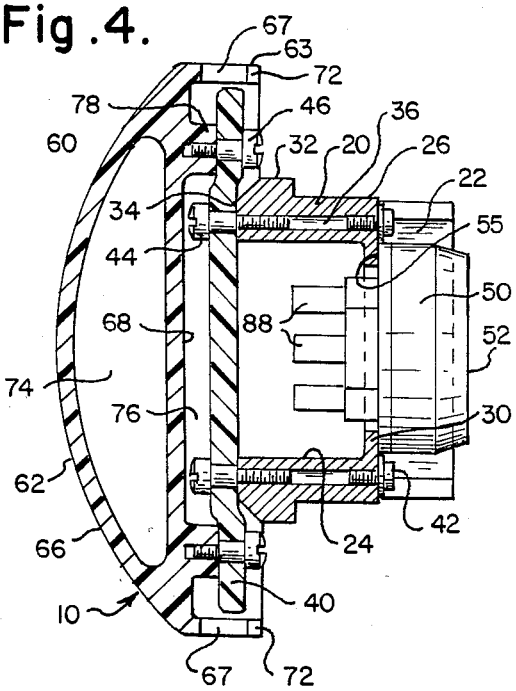
FIG. 4 is a side elevational section view along the line IV—IV of FIG. 2.

Referring to FIG. 4, cap 60 has a downwardly extending annulus 78 to which the insulation layer 40 is attached by screws 46 or any other suitable known means. The handle 62 is molded so that a first airspace 74 is defined between the handle 62 and the lower surface 68. A second airspace 76 is defined between the lower surface 68 and the insulation layer 40.

The barrel member 20 has a bore 22, an interior surface 24, an exterior surface 26, an interior flange 30 and an exterior flange 32. Two channels 36 extend through the barrel member 20 from the upper rim 34 to the interior flange 30. Screws 44, which connect the barrel member 20 to the insulation layer 40 extend downwardly into the channels 36. Screws 42 which connect the socket 50 to the interior flange 30 extend upwardly into the channels 36.

The socket 50 is positioned in the bore 22 of the barrel member 20. The socket has a bore 52 for receiving the lamp 14. There are three slits 54 in the interior of the socket 50, shown in FIG. 2, to engage corresponding structures on the lamp 14. An alignment hole 56 guides the lamp 14 into the socket to properly orient the corresponding structures on the lamp 14 into the slits 54. The socket 50 has a shoulder 55 which meets the interior flange 30 of the barrel member 20. Two tabs 58 protrude outwardly from the socket. The screws 42 hold the tabs 58 of the socket 50 to the interior flange 30 of the barrel member 20.

Figure 6:
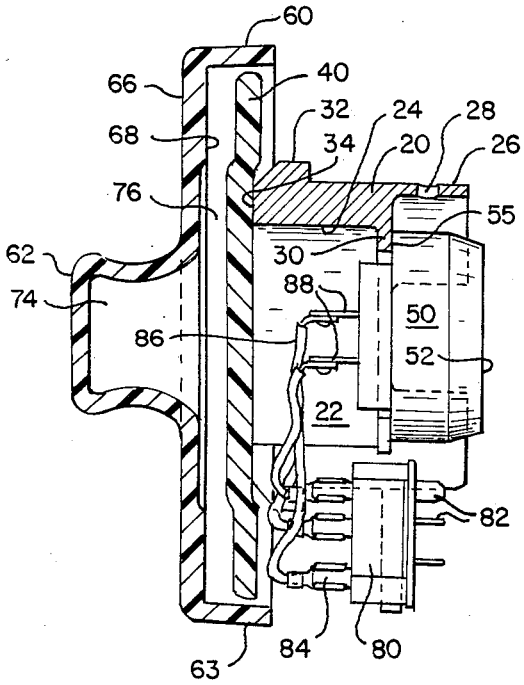
FIG. 6 is a side elevational section view along the line VI—VI of FIG. 2.

Each of three contacts 88 on top of the socket 50 is connected to a wire 86 which may be directly connected to the lighting unit 12 or, preferably, to a contact 84 on plug 80. Referring to FIG. 6, there are three contacts 84 on plug 80. Three prongs 82 engage a receptacle in the lighting unit 12. Plug 80 is either integral to barrel member 20 or fixedly connected by means of screws 48, or any other suitable known means. In prior art devices, or in the embodiment of the present invention in which the wires 86 are directly connected to the lighting unit 12, the lampholder 10 can only be removed partially when the lamp 14 has to be changed. However, when plug 80 provides the means for electrical communication from the unit 12 to the socket 50 and lamp 14, the lampholder 10 can be completely removed. In situations where it is desirable to change a lamp 14 quickly, a second lampholder 10, may be kept readily available, with a fresh lamp 14 in the socket 50 for immediate insertion into the lighting unit 12. The plug 80 guarantees a complete interruption of electrical current when the lampholder 10 is removed. Thus, any danger from exposure to live current is eliminated.

The lampholder 10 can be removed quickly because of the design of cap 60. The need for a special tool to remove the lampholder 10 from the opening 16 of unit 12 has been eliminated because cap 60 can be grasped by hand. In order to be safe to the touch, the Underwriters' Laboratories (U.L.) have determined that exposed surfaces should not exceed 167° F. for nonmetallic materials.

Cap 60 is made of heat resistant material, such as thermoplastic or thermoset materials. The thermoplastic material may be selected from the group consisting of polysulfone, polyether sulfone, polyether imide, polyamideimide, polyether ether ketone, or polyphenylene sulfide. The thermoset material may be either epoxy or a phenolic. The insulation layer 40 should be made of the same material.

The windows 67 should be of a sufficient size to vent so much of the heat emitted from the lamp 14, that, together with the cap 60 material, the temperature of the upper surface 66 does not exceed 167° F. Should a different temperature maximum be desirable, the material and the number and size of the windows 67 can be varied. At least one window 67 will always be required for any of the preferred materials. Lampholders 10 having six windows 67 in cap 60, have been used successfully without exceeding 167° F.

The windows 67 provide a chimney through which the heat can escape. The first airspace 74 under the handle 62 and the second airspace 76 between the lower surface 68 and the insulation layer 40 also contribute to the reduced temperature of the upper surface 66. The first and second airspaces 74, 76, windows 67 and the heat resistant material combine to dissipate the heat emitted from the lamp 14 so that upper surface 66 will not exceed a predetermined temperature during normal use.

The heat resistant material can tolerate the heat emitted from the lamp 14 when electrical power is communicated thereto under normal circumstances. Cap 60 is structured to prevent cracking. The relief joints 72 are necessary to prevent the cap 60 from cracking because of the uneven distribution of heat across the cap 60, particularly around the skirt 63 where relatively thin segments of material surround the windows 67. Four relief joints 72 have been shown to provide acceptable results. More or less may be appropriate, however, depending upon the choice of material, the number and size of the windows 67, and the actual amount of heat emitted by the lamp 14.

The barrel member 20 has a recess 28 on its exterior 26 for receiving a spring biased lock ball 95 in the lighting unit 12. Any suitable known means for releasably engaging the lighting unit 12 can be used. The spring biased lock ball assembly 95 may be in the barrel member 20 and the recess 28 may be in the lighting unit 12.

What is claimed is:

1. A lampholder for insertion into an electrically powered lighting unit comprising:

a socket for receiving the lamp;

means for communicating electrical power from the unit to the lamp;

a member having a bore therethrough for receiving said socket;

a cap structured to prevent cracking superposing said socket and being made of a material selected from the group consisting essentially of polysulfone, polyether sulfone, polyether imide, polyamideimide, polyether ether ketone, polyphenylene sulfide or an epoxy or a phenolic, said cap having an upper surface, a lower surface so disposed relative to said upper surface that a first airspace is defined therebetween, a heat insulation layer disposed between said member and said lower surface, said heat insulation layer being made from said material and being so connected to said lower surface that a second airspace is defined therebetween, an annular skirt and a plurality of windows formed in said skirt of sufficient size to vent so much of the heat emitted from the lamp when electrical power is communicated thereto, that said upper surface, due to the combination of said material, said first and second airspaces and said sufficiently sized windows, will not exceed a predetermined temperature during normal use;

a handle molded on said upper surface; and means for releasably engaging the unit.

2. A lampholder as recited in claim 1 wherein said cap has a plurality of relief joints in said skirt to prevent cracking from the uneven distribution of heat.

3. A lampholder as recited in claim 1 wherein said predetermined temperature is 167° F.

4. A lampholder as recited in claim 1 wherein the unit has first contacts, said power communicating means is a plug connected to said member and adapted to releasably engage the first contacts within the unit and at least one second contact disposed on said socket connected to said plug for communicating electrical power from the unit to the lamp.

5. A lampholder as recited in claim 1 wherein the lighting unit is a surgical light.

6. A lampholder for insertion into and removal from an electrically powered lighting unit comprising:

a socket for receiving the lamp and communicating electrical power from the unit to the lamp;

a cap structured to prevent cracking superposing said socket, said cap having an upper surface, a lower surface proximate said socket and at least one window of sufficient size to vent heat emitted from the lamp when electric power is communicated thereto, said cap being made of such heat resistant material that said lower surface can tolerate the heat emitted from the lamp;

heat insulation means disposed between said lower surface of said cap and said socket, said heat insulation means being so connected to said lower surface that an airspace is defined therebetween;

said airspace, said window and said material being combined to so dissipate the heat emitted from the lamp when electric power is communicated thereto that said upper surface will not exceed a predetermined temperature during normal use; and, means for releasably engaging the unit.

7. A lampholder as recited in claim 6 wherein said cap has a sufficient number of relief joints to prevent cracking from the uneven distribution of heat.

8. A lampholder as recited in claim 6 wherein the unit has an electrical contact and said socket is connected to a plug adapted to releasably engage the electrical contact within the unit for communication of electrical power from the unit to the lamp in said socket.

9. A lampholder as recited in claim 6 wherein said upper surface includes a handle for manually inserting the lampholder into and removing the lampholder from the unit.

10. A lampholder as recited in claim 6 wherein said material is thermoplastic.

11. A lampholder as recited in claim 6 wherein said material is selected from the group consisting of an epoxy and a phenolic thermosetting substance.

12. A lampholder as recited in claim 6 wherein said predetermined temperature is 167° F.

13. A lampholder as recited in claim 6 further comprising a member connected to said heat insulation means, said member having a bore therethrough for receiving said socket.

14. A lampholder as recited in claim 13 wherein said engaging means is a recess in said member.

* * * * *

UNITED STATES PATENT AND TRADEMARK OFFICE

CERTIFICATE OF CORRECTION

PATENT NO. : 4,578,742

DATED : Mar. 25, 1986

INVENTOR(S) : Roy S. Klein, Joel C. Gehly and Joseph T. Sestak

It is certified that error appears in the above—identified patent and that said Letters Patent is hereby corrected as shown below:

Col. 4, line 7, delete "polyamideimide" and substitute therefor --polyamide-imide--.

Signed and Sealed this

*Tenth* Day of *June 1986*

[SEAL]

*Attest:*

DONALD J. QUIGG

*Attesting Officer*

*Commissioner of Patents and Trademarks*